United States Patent [19]

Rollot et al.

[11] 4,336,925

[45] Jun. 29, 1982

[54] DEVICE FOR FIXING AND SEALING STAVE PLATES FOR A BLAST FURNACE

[75] Inventors: Pierre H. Rollot; Jean A. Cordier, both of Dunkerque; Raymond L. Briche, Thionville, all of France

[73] Assignees: Technilor, Hagondange; Usinor, Paris, both of France

[21] Appl. No.: 156,623

[22] Filed: Jun. 5, 1980

[30] Foreign Application Priority Data

Jun. 6, 1979 [FR] France ..... 79 15074

[51] Int. Cl.[3] ..... C21B 7/10

[52] U.S. Cl. ..... 266/193; 122/6 B

[58] Field of Search ..... 266/190, 193, 194; 122/6 A, 6 B

[56] References Cited

FOREIGN PATENT DOCUMENTS

| | | | |
|---|---|---|---|
| 2743380 | 6/1978 | Fed. Rep. of Germany | 266/193 |
| 2160724 | 2/1973 | France | 266/190 |
| 273225 | 12/1966 | U.S.S.R. | 122/6 B |

OTHER PUBLICATIONS

Stagley et al., "Iron & Steel Eng'r", May 1968, pp. 89–97.

*Primary Examiner*—G. O. Peters

*Attorney, Agent, or Firm*—Pollock, Vande Sande & Priddy

[57] ABSTRACT

The device permits the fixing of a stave plate to the armour shell of the blast furnace by means of a washer and a cup-shaped ring which are welded externally both to the shell and to protecting sleeves for inner water circulating tubes which are extended to outside the shell.

The sealing is achieved by the interposition under compression of a preformed flexible apertured rectangular joint element and a preformed circular joint element of silicone elastomer or like plastics material, between the shell and the stave plate with adhesion on the bearing faces. It is completed by an injected mass and an annular joint element between the water circulating tubes and the corresponding protecting sleeves.

The device is completed by the provision of packing products respectively between the inner wall of the shell and the stave plates and in gaps between two adjacent stave plates.

6 Claims, 7 Drawing Figures

FIG. 4
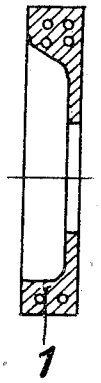
FIG. 5
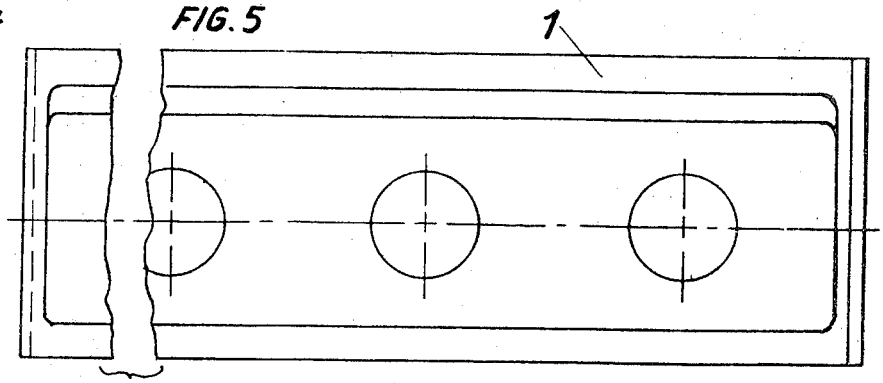
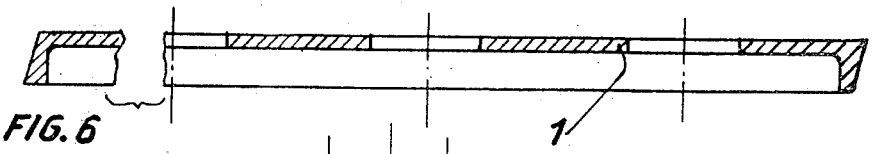
FIG. 6
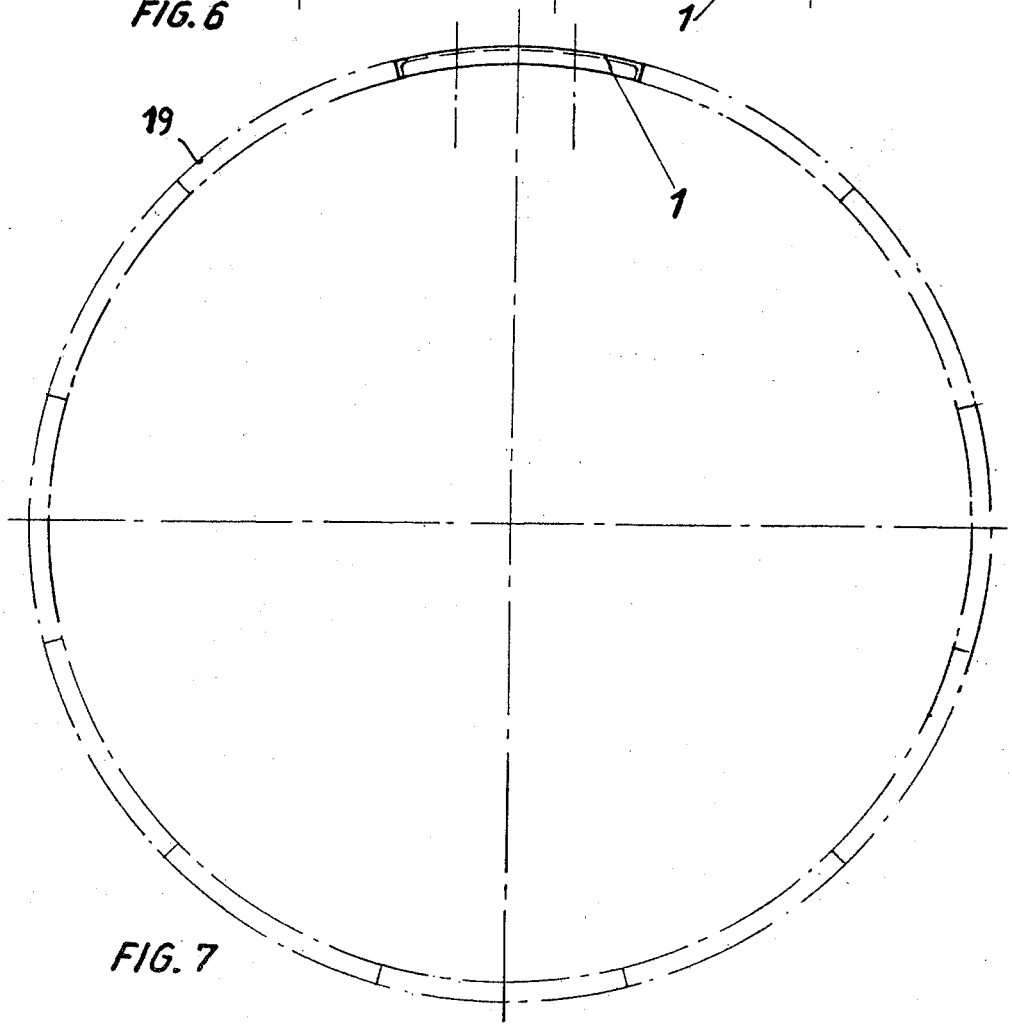
FIG. 7

DEVICE FOR FIXING AND SEALING STAVE PLATES FOR A BLAST FURNACE

DESCRIPTION

The present invention relates to a device for, on one hand, fixing and maintaining stave plates against the inner wall of an armour shell of a blast furnace and, on the other hand, sealing the gas passages between the shell and the stave plates inside the blast furnace and at the entrances and at the exits of the cooling fluid circulating tubes toward the exterior of the blast furnace.

In contrast to the devices usually employed which provide fixing bolts extending through the shell by way of orifices provided for this purpose so as to maintain the stave plates against the shell, the present device enables these specific means for hooking and maintaining the plates against the inner wall of a blast furnace to be dispensed with.

In this way there is avoided:

the creation of a large number of apertures in the shell, the openings formed in the latter, however small they may be, being always harmful to its strength and often a source of the initiation of cracks;

the need to solve the problem of the seal at the passage of gases in the region of the orifices provided for the passage of the bolts fixing the stave plates.

The present device comprises elements, i.e. cup-shaped rings and washers, welded, on one hand, to the shell of the blast furnace and, on the other hand, to the sleeve protecting the water inlet and outlet tubes of the stave plates, the rings being placed in the upper parts of the plates whereas the washers are placed in the lower parts.

The gases, namely alkaline vapors, carbon, formed in the course of the preparation of the iron in the enclosure of the blast furnace, manage to pass through the refractory lining by way of the joints, cracks or spaces between the stave plates and may travel along the armour shell inside the blast furnace, or may escape to the exterior of the blast furnace either by way of the orifices provided in the shell for the passage of the water inlet and outlet tubes of the stave plates or by way of the annular space formed by the water inlet and outlet tubes and the tubular protecting sleeves.

The gases, which are mainly CO and $CO_2$, constitute a serious danger and hindrance to the personnel if they escape from the blast furnace.

The passage of hot gases between the shell and the stave plates is an element which disturbs the good operation of said plates, one of the functions of which is to prevent the sheets constituting the armour shell from undergoing abnormal elevations of temperature which have an adverse effect on their strength.

The passage of the hot gases between the shell and the stave plates is a source of formation of deposits, mainly carbon deposits, which gradually exert considerable forces on the stave plates as they have a tendency to urge the latter inwardly of the blast furnace, this mechanism of the deposit of carbon by the passage of gases of the blast furnace along a cold wall being a known phenomenon.

The device according to the invention permits the avoidance of these drawbacks in that it prevents the gases from travelling along the inner wall of the shell and consequently avoids the possibility of formation of carbon deposits.

This is achieved by interposing between the stave plates and the inner wall of the shell flexible preformed elements capable of ensuring, on one hand, the seal at the passages of gas and, on the other hand, a connection between the shell and the plates which has sufficient elasticity to absorb under all conditions of operation of the blast furnace the deformations that the plates undergo by the effect of expansion.

The cup-shaped rings and washers for fixing purposes are of weldable steel and of such thickness and shapes that the cup-shaped rings are capable of undergoing slight deformations and the washers can act as a fixed point.

Their dimensions are the result of calculations of strength at the pressure liable to prevail within the blast furnace and of geometric limits relating to the dimensions of the stave plates and also of the distance provided between the inlets or outlets of the water circulating tubes.

The washers are carefully cut out from weldable steel and the weld bead connecting them to the shell is determined by a number of weld passes so that there is a strong and perfectly sealed junction.

The cup-shaped rings are pressed out from thin sheet steel which however has a good elastic limit so as to impart to the rings the best possible flexibility when they have been welded. The weld beads of connection to the shell are appropriate to the production of a perfectly sealed and strong junction.

These washers and cup-shaped rings maintain and stave plates against the shell with sufficient effect and pressure while they prevent the gases prevailing in the enclosure of the blast furnace from escaping to the exterior. They consequently perform a fixing function, a sealing function, and a function of putting the sealing elements placed between the shell and the stave plates under compression.

The operation of putting under compression the sealing and fixing elements of the stave plates is carried out with particular means and materials adapted for the obtainment of the desired compression forces.

In order to complete the fixing system, on one hand, packing products are placed in the spaces formed between the different stave plates and in the space formed between the inner wall of the armour shell and the cold side of the stave plates and, on the other hand, flexible sealing elements, described in detail hereinafter, are installed whose purpose is to absorb the movements of the stave plates under the effect of their deformation due to expansion and to provide a seal at the gas passages along the inner wall of the shell.

The sealing device according to the invention comprises a series of flexible preformed joint elements whose shape permits the fitting thereof on support bosses provided on the stave plates.

They are produced by impression molding silicone elastomer or like plastics product having a high elongation capability and resisting a temperature in the neighborhood of 300° C., its mass being rendered more elastic by a method employed when forming the joint.

The lower part of the stave plates are adhered to joint elements of rectangular shape having a suitable thickness which depends on the design of the plates so that, when the latter have been mounted inside the blast furnace, they constitute a continuous sealing belt in contact with the shell and with the cold side of the stave plates.

Depending on the number of rings of plates placed in position in a blast furnace, there is the same number of sealing belts preventing the passages of gases along the inner wall of the blast furnace, the device being suitable from the bosh zone to the top of the stack.

Further, in the upper part of the stave plates each sleeve protecting the water outlet tube is provided with a flat circular joint element performing the function of an elastic support of the stave plates against the shell and of a baffle for a possible flow of gases toward the the exterior of the blast furnace.

These joint elements are also preformed from a silicone elastomer or like plastics product and consequently have the same properties as the previously-described rectangular joint elements.

The sealing device is completed in the region of the outer end of the sleeves outside the armour shell by the provision of sealing elements in the form of rings obtained by the forming of a silicone elastomer or like plastics products. These rings are disposed in the annular space between the water inlet and outlet tubes and the protecting sleeves, these sealing elements being held in position by a metal washer which is rendered rigid with the water circulating tubes by spot welding.

These ring-shaped sealing elements are held in position by a gripping collar or like fixing means which holds them in position by a gripping action and puts them under compression between the metal washer and a packing of silicone elastomer or like plastics product which is injected upon assembly, between the water circulating tube and the protecting sleeve after an asbestos packing gasket has been placed in position.

Further features and advantages of the invention will be better understood from the ensuing description with reference to the accompanying drawings in which:

FIGS. 4, 5 and 6 are views of the preformed rectangular joint element in plan and in section;

FIG. 7 is a top view of the arrangement of the rectangular joint elements which constitutes a continuous belt for each ring of stave plates;

Figure 1:
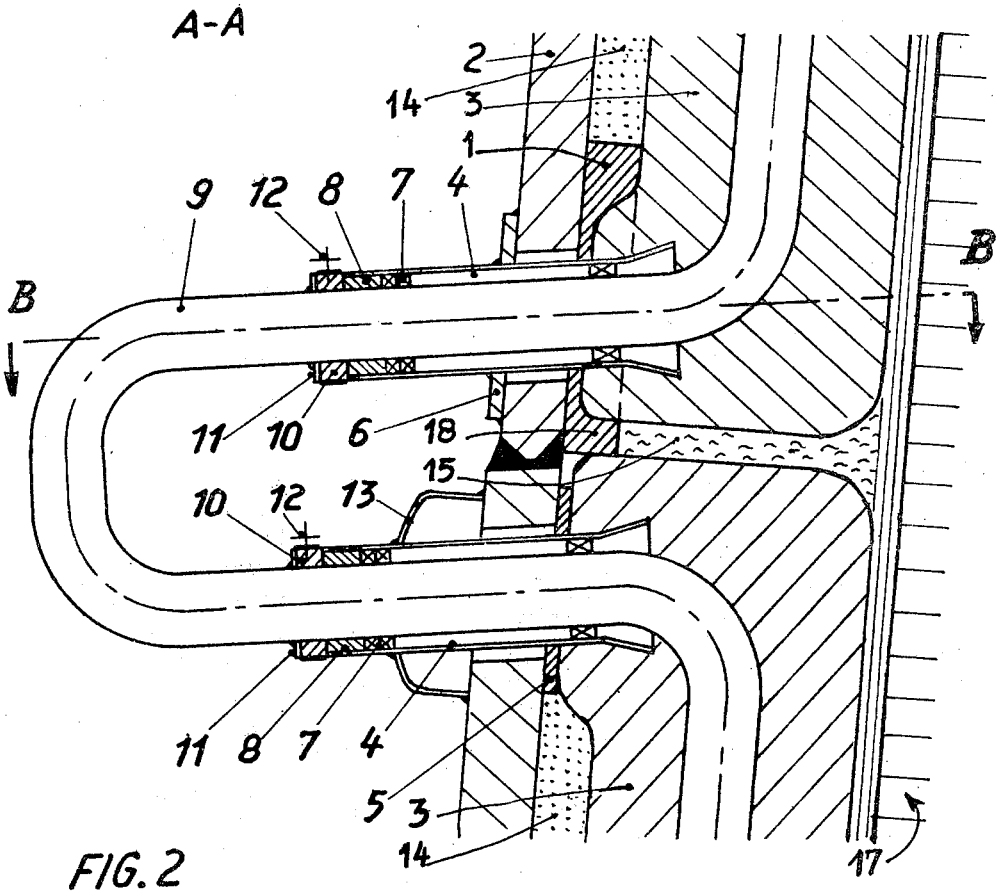
FIG. 1 is a view partly in section and partly in elevation of two adjacent stave plates provided with circular joint elements in the upper part and rectangular joint elements in the lower part. In this figure, the upper part of the plate corresponds to the lower part of the drawing and the lower part of the plate corresponds to the upper part of the drawing.
Figure 2:
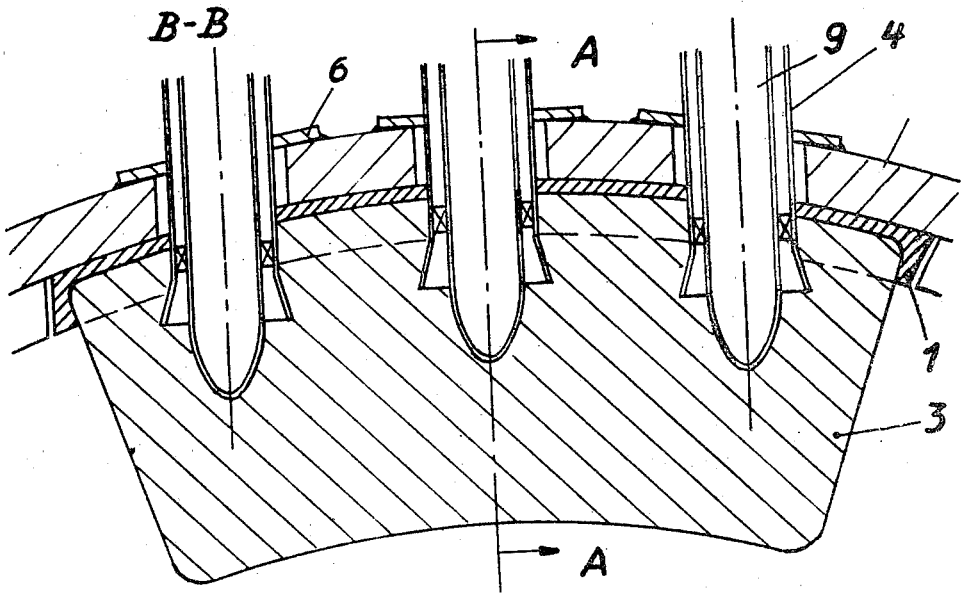
FIG. 2 is a horizontal sectional view of the lower part of a stave plate showing the position of the rectangular joint element.
Figure 3:
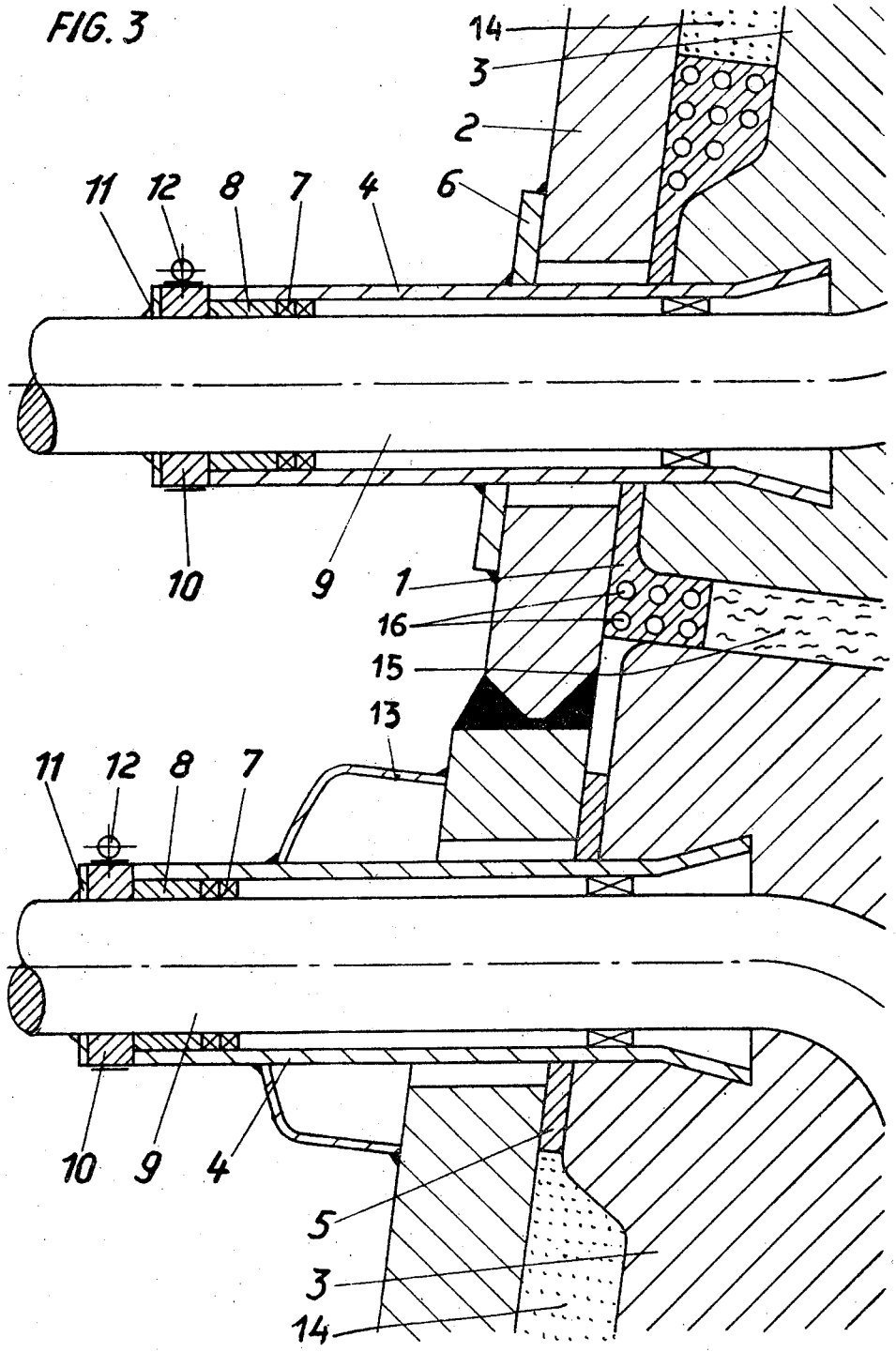
FIG. 3 is a sectional view, to a scale larger than that of FIG. 1, of more particularly the joint elements between the water circulating tube and the sleeves.

As shown in the drawings, the device comprises:

(a) In the lower part of the stave plates: a preformed rectangular joint element 1 provided with passage orifices for each tubular protecting sleeve 4 of the inlet of the water circulating inner tubes 9. This joint element 1 is put under compressive stress when placing and fixing the stave plates 3 in position so as to achieve a definite bearing on the inner wall of the armour shell 2 and on the stave plates 3. It is advised to fix the joint element by adhesion with the use of a silicone elastomer or like plastics product on both bearing faces, but the joint element may be held in a satisfactory manner by adhesion of only the face of the joint element which contacts the cold side of the stave plate 3. In order to improve the elasticity of the joint element 1, the latter has, embedded in its mass, hollow bodies 16 as shown in FIG. 3. Each rectangular joint element 1 has, in its lower part, a heel 18 which is engaged and pressed against the plate on which it is mounted and the upper part of the plate located immediately below.

(b) In the upper part of the stave plates: a preformed flat circular joint element 5, also obtained from a silicone elastomer or plastics product, is placed at each outlet part of the protecting sleeve 4 between the inner wall of the shell 2 and the stave plate 3. This joint element 5 is put under compressive stress when mounting the stave plates 3 and preferably adhered to both bearing faces.

The device for sealing the passages of gas between the protecting sleeve 4 and the water circulating tube 9 applies both to the water circulation inlet tubes in the lower part of the stave plates 3 and to the water circulating outlet tubes placed in the upper part of the stave plates.

It is formed by a double braided packing gasket 7 which is adapted to block an injected flexible mass 8 of silicone elastomer or like plastics product placed between the water circulating tube 9 and the protecting sleeve 4. This assembly is held in position by a preformed ring-shaped joint element 10 which is obtained with the product described hereinbefore and placed between the injected mass 8 and a fixed abutment in the form of a metal washer 11 which is rendered rigid with the tube 9 by spot welding.

The flexible joint element or ring 10 is held under compression by a clamping collar 12 or like fixing means.

For the purpose of fixing the stave plates, a washer 6 is welded both externally on the armour shell 2 and on the tubular protecting sleeve 4. This washer 6 constitutes the fixed point in the lower part of the stave plates.

A cup-shaped ring 13 is also welded both externally to the shell 2 and to the tubular protecting sleeve 4. This ring 13 constitutes the movable point in the upper region of the stave plates.

Apart from the fact that they fix the stave plate 3 and put the sealing joint elements 1 and 5 under compression, the washers 6 and the cup-shaped rings 13 provide a perfect seal against the possible flow of the gases of the blast furnace which might escape by way of the apertures provided in the shell for the passage of the protecting sleeves 4.

In addition to the present device and in order to impart a necessary unitary structure to the assembly of the stave plates 3 and shell 2, special packing products 14 and 15 are placed in position as the mounting of the stave plates progresses.

These products have the qualities of flexibility and resistance to hot and corrosive gases which prevail in the enclosure of the blast furnace. They also have the qualities of thermal conductivity and adherence to the metal masses 3 and 2 with which they are in contact.

The packing product 14 placed between the inner wall of the shell 2 and the stave plate 3 is a flexible refractory concrete based on magnesium oxide which resists CO and is injected when mounting the stave plates. Such a packing is commercially available under the name Plasmag from the firm Société Pasek France.

The packing product 15 placed in the gaps between two adjacent stave plates 3 is a fluidtight fibrous cement of refractory fibers in a ceramic binder which resists about 1200° C. Such a product is commercially available from the firm Société SEPR.

In FIG. 1 there is designated by the general reference numeral 17 the layer of refractory bricks which is connected to the inner faces of the stave plates by known methods of preparation of this type of refractory layer for protecting the shell.

FIGS. 4, 5 and 6 show the joint element 1 in plan and in section and FIG. 7 shows a joint element 1 which constitutes one of the elements of a sealing belt placed on the circumference 19 of the inner wall of a blast furnace.

We claim:

1. In a blast furnace comprising an armour shell, stave plates disposed in superimposed rings adjacent an inner face of the shell, said stave plates each having an inner cooling fluid circulating tube which extends out of upper and lower parts of the stave plate inside respective protecting sleeves, said tubes extending through orifices provided in the shell; the improvement wherein, for the purpose of fixing and sealing the stave plates, in said lower parts of the stave plates, the protecting sleeves are extended through the shell, and a washer is welded to each sleeve in said lower part and to the shell for fixing the sleeve, said washers welded to the sleeves constituting an assembly which both fixes the stave plates and maintains under compression between the stave plates and the inner face of the shell a continuous sealing belt, which belt comprises a juxtaposition of substantially rectangular joint elements, preformed of a silicone elastomer by molding, each of which joint elements comprises in a lower part thereof a heel which is engaged and gripped between the plate on which it is mounted and an upper part of a stave plate located immediately therebelow each of which joint elements substantially fits the shape of said lower part of the corresponding stave plate and defines an aperture for the passage of a corresponding sleeve and, in said upper parts of the stave plates, the sleeves are also extended out of the shell and a cup-shaped ring is welded both to each sleeve in said upper part and to the shell and forms an assembly which constitutes means both for fixing the stave plates to the shell and for maintaining under compression between the stave plates and the inner face of the shell substantially circular flat joint elements each of which joint elements surrounds a corresponding sleeve of said upper part of the stave plates.

2. The blast furnace claimed in claim 1, wherein the substantially rectangular joint elements have hollow bodies embedded in their mass in the course of the molding thereof.

3. The blast furnace claimed in claim 1, or 2, further comprising, in the region of an end portion of each sleeve outside the shell, a fixed abutment rigid with the corresponding tube, an annular joint element surrounding the tube and compressed between an end edge of the sleeve and the fixed abutment, an annular asbestos gasket interposed between the sleeve and the tube, and a flexible material in an injected state between the tube and the sleeve therefor and between said asbestos gasket and the annular joint element.

4. The blast furnace claimed in claim 1, or 2, comprising packing products interposed respectively between the inner face of the shell and the stave plates and in gaps between immediately adjacent stave plates.

5. The blast furnace claimed in claim 4, wherein said packing products between the inner face of the shell and the stave plates comprise a flexible refractory concrete based on magnesium oxide which resists CO.

6. The blast furnace claimed in claim 4, wherein said packing products in the gaps between adjacent stave plates comprise a fluidtight fibrous cement of refractory fibers in a ceramic binder.

* * * * *